US005107954A

United States Patent [19]

Fujimoto: Mineyuki

[11] Patent Number: 5,107,954

[45] Date of Patent: Apr. 28, 1992

[54] CONTROL DEVICE FOR MOBILE VEHICULAR APPARATUS WITH AERIAL PLATFORM

[75] Inventor: Fujimoto: Mineyuki, Okegawa, Japan

[73] Assignee: Aichi Sharyo Co. Ltd., Nagoya, Japan

[21] Appl. No.: 607,104

[22] Filed: Oct. 31, 1990

[51] Int. Cl.[5] ..... B66F 11/04; B66F 9/06

[52] U.S. Cl. ..... 182/2; 212/165; 74/474

[58] Field of Search ..... 182/2, 148; 74/474; 212/163, 165, 267

[56] References Cited

U.S. PATENT DOCUMENTS

| | | | |
|---|---|---|---|
| 2,450,152 | 9/1948 | Miller | 182/2 |
| 2,616,768 | 11/1952 | Stemm | 182/2 |
| 2,954,092 | 9/1960 | Trump | 182/2 |
| 3,156,313 | 11/1964 | Peterson | 182/2 |
| 3,250,343 | 5/1966 | Maloney | 182/2 |
| 3,866,713 | 2/1975 | Carpenter et al. | 182/2 |
| 4,724,924 | 2/1988 | Breyer | 182/2 |

FOREIGN PATENT DOCUMENTS

| | | |
|---|---|---|
| 60-147923 | 10/1985 | Japan . |
| 61-81111 | 4/1986 | Japan . |
| 62-178108 | 8/1987 | Japan . |
| 62-268312 | 11/1987 | Japan . |
| 63-144995 | 9/1988 | Japan . |
| 63-173193 | 11/1988 | Japan . |
| 64-38273 | 3/1989 | Japan . |
| 64-38274 | 3/1989 | Japan . |
| 1-134912 | 9/1989 | Japan . |
| 1-231800 | 9/1989 | Japan . |
| 2-28895 | 2/1990 | Japan . |
| 2-63992 | 5/1990 | Japan . |
| 2-91789 | 7/1990 | Japan . |
| 2-103089 | 8/1990 | Japan . |
| 2-104988 | 8/1990 | Japan . |
| 2-114308 | 9/1990 | Japan . |
| 2-129108 | 10/1990 | Japan . |
| 2-262813 | 10/1990 | Japan . |

*Primary Examiner*—Reinaldo P. Machado
*Attorney, Agent, or Firm*—Sandler, Greenblum, & Bernstein

[57] ABSTRACT

A mobile vehicular apparatus for moving an operator around a three-dimensional aerial work location such as an electric cable or wire supported on posts includes a mobile vehicle having a vehicle body, a boom movably mounted on the vehicle body, a platform mounted on a distal end of the boom, for carrying an operator thereon, the platform having an operator's seat, and a control device operable by the operator on the platform, for moving the boom to move the platform into a three-dimensional position. The control device comprises a plurality of swingable foot treadles disposed in front of the operator's seat, detecting means for detecting swinging movement of the foot treadles, and control means for controlling movement of the platform in response to detected signals from the detecting means. The foot treadles are arranged such that directions in which the foot treadles swing correspond respectively to directions in which the platform moves.

11 Claims, 4 Drawing Sheets

CONTROL DEVICE FOR MOBILE VEHICULAR APPARATUS WITH AERIAL PLATFORM

BACKGROUND OF THE INVENTION

The present invention relates to a mobile vehicular apparatus which includes an aerial platform or cabin and manipulators that are mounted on the distal end of a telescopic boom, which can be turned, moved vertically, and extended and contracted to move the platform or cabin carrying the operator to a desired three-dimensional position, and more particularly to a system for controlling movement of the telescopic boom.

Various mobile vehicular apparatus with aerial platforms or cabins have been proposed so far. For example, Japanese Laid-Open Utility Model Publication No. 63(1988)-173193, discloses a mobile vehicular apparatus which has a manipulator and a platform for carrying an operator who controls the manipulator on the distal end of a boom. The platform is equipped with a plurality of manually operated control levers which can be manually operated on by the operator to control operation of the manipulator and the boom. However, even if the operator uses both hands, only two kinds of operation can be performed at a time, and hence the efficiency is poor.

In many mobile vehicular apparatus, only a platform is attached to the distal end of a boom, with no manipulator provided. Such mobile vehicular apparatus are often used to handle electric cables supported on poles. While an electric cable is being repaired, serviced, or otherwise handled, the operator is required to use his both hands. Therefore, in order to control operation of the boom, the operator has to interrupt the process of handling the electric cable and then operate the boom, resulting in poor efficiency.

U.S. Pat. No. 3,866,713 issued to Carpenter et al. discloses a mobile vehicular apparatus with a platform on the distal end of a boom. The platform has control foot treadles for controlling operation of the boom and also the position of the platform. The disclosed mobile vehicular apparatus is typically used to harvest tree borne fruit. The operator in the platform manipulates the foot treadles with his feet for the control of the position of the platform, so that the operator can exclusively use the hands to harvest tree borne fruit.

With the disclosed mobile vehicular apparatus, however, the foot treadles are merely juxtaposed on the floor of the platform, and the directions in which the foot treadles are manipulated do not correspond to the directions in which the platform is moved. The operator is therefore required to be skilled for quick and efficient manipulation of the foot treadles. If the operator manipulates the foot treadles in error, then the platform may be moved in a direction in which the operator did not intend to move the platform. Moreover, operator-initiated movement of the foot treadles is transmitted as a pneumatic pressure to hydraulic pressure control valves for controlling movement of the platform. Since air pipes are required, the entire control system is complex and large in size. Another problem is that the accuracy of controlling operation is relatively poor because compressible air is used as a control signal transmitting medium.

SUMMARY OF THE INVENTION

It is an object of the present invention to provide a control device for controlling an aerial platform and a boom of a mobile vehicular apparatus, the control device including foot treadles operable in directions corresponding to directions in which the platform is movable, so that the platform can be controlled easily and smoothly without skilled manipulating efforts on the part of the operator.

Another object of the present invention is to provide a control device of the type described above which includes a control system that is simple in structure and small in size.

Still another object of the present invention is to provide a control device of the type described above which has a control system capable of controlling the aerial platform and the boom with high accuracy.

According to the present invention, there is provided an apparatus for moving an operator around a three-dimensional aerial work location, comprising a mobile vehicle having a vehicle body, a boom movably mounted on the vehicle body, a platform mounted on a distal end of the boom, for carrying an operator thereon, the platform having an operator's seat, and a control device operable by the operator on the platform, for moving the boom to move the platform into a three-dimensional position, the control device comprising a plurality of swingable foot treadles disposed in front of the operator's seat, detecting means for detecting swinging movement of the foot treadles, and control means for controlling movement of the platform in response to detected signals from the detecting means, the foot treadles being arranged such that directions in which the foot treadles swing correspond respectively to directions in which the platform moves.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
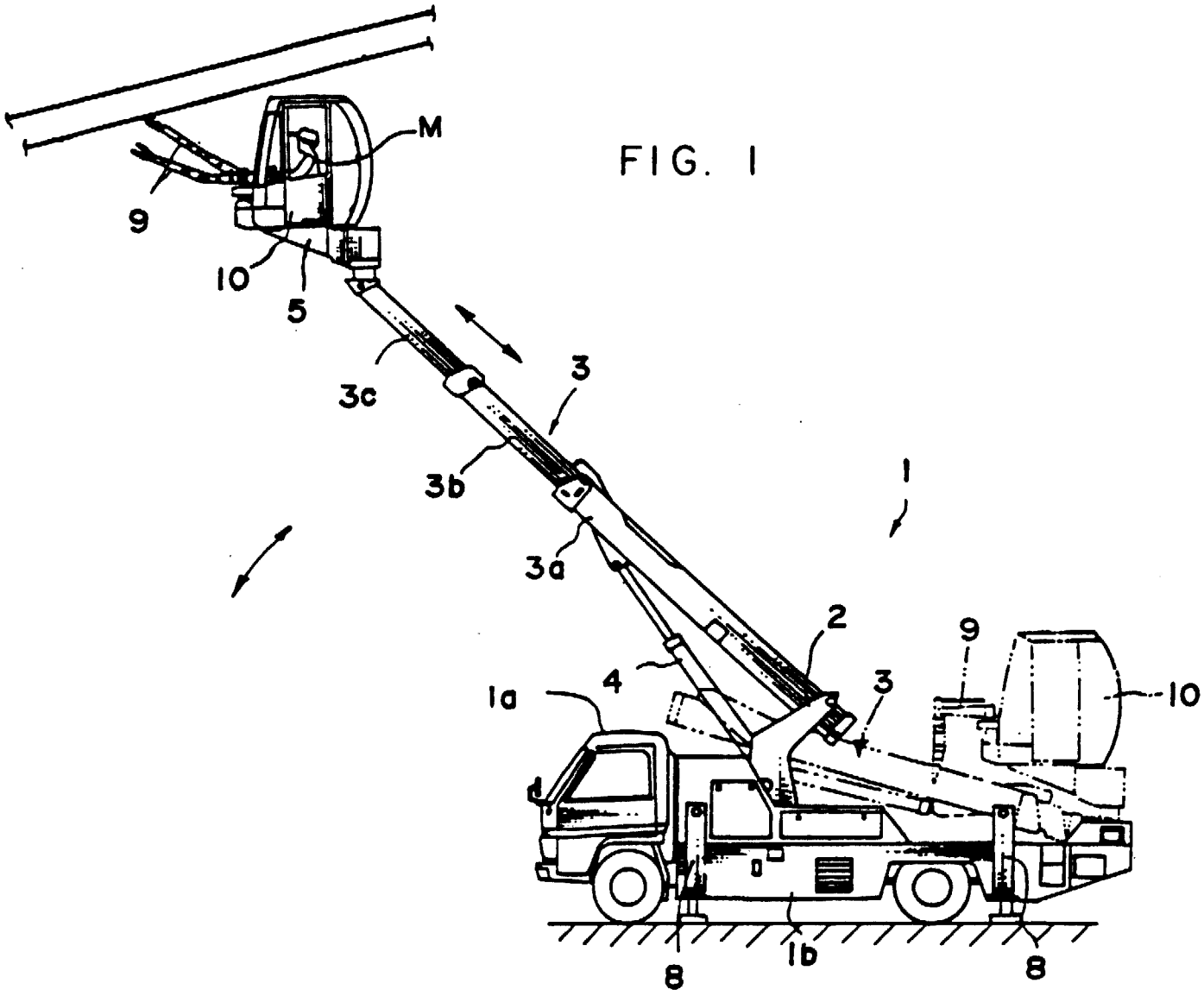
FIG. 1 is a side elevational view of a mobile vehicular apparatus with an aerial cabin, incorporating a control device according to the present invention.

FIG. 1 shows a mobile vehicular apparatus with an aerial platform, incorporating a control device according to the present invention.

The mobile vehicular apparatus includes a mobile vehicle having a driver's cabin 1*a* and a vehicle body 1*b*. The vehicle body 1*b* supports a turntable 2 which can be turned by a turntable motor (not shown in FIG. 1). On the turntable 2, there is mounted a telescopic boom 3 which is upwardly extensible and downwardly collapsible, i.e., vertically swingable, by a cylinder 4. The telescopic boom 3 comprises three boom members, i.e., a distal boom member 3a, an intermediate boom member 3b, and proximal boom member 3c. The distal boom member 3a and the intermediate boom member 3b are slidably movable into and out of the proximal boom member 3c by a hydraulic cylinder (not shown in FIG. 1) disposed in the telescopic boom 3. A cabin 10 is mounted on the tip end of the distal boom member 3a through a support 5. The cabin 10 carries an operator M therein and serves as a platform. The support 5 is swingable horizontally and vertically with respect to the boom 3 so that the cabin 10 can be held horizontally at all times. The cabin 10 is also rotatable horizontally by a cabin motor (not shown).

The vehicle body 1b has four outriggers 8 at four corners, i.e., front left, front right, rear left, and rear right corners, the outriggers 8 projecting laterally. The outriggers 8 can be extended downwardly into contact with ground. When in operation, the outriggers 8 are forcibly extended downwardly to support the vehicle body 1b.

Two manipulators 9 are mounted on the front side of the cabin 10. The manipulators 9 can be operated by the operator M who sits in the cabin 10.

The operator M in the cabin 10 can effect control processes to turn, raise and lower, and extend and contract the boom 3, turn the cabin 10, and operates the manipulators 9. Since a complex control process is required to operate the manipulators 9, both hands of the operator M are occupied to control the operation of the manipulators 9, but not available for effecting other control operations.

Figure 2:
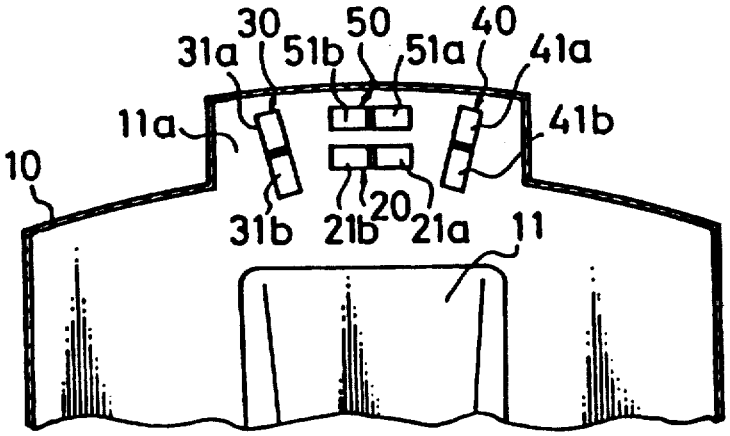
FIG. 2 is a fragmentary plan view, partly in cross section, of the floor of the cabin of the mobile vehicular apparatus shown in FIG. 1.
Figure 3:
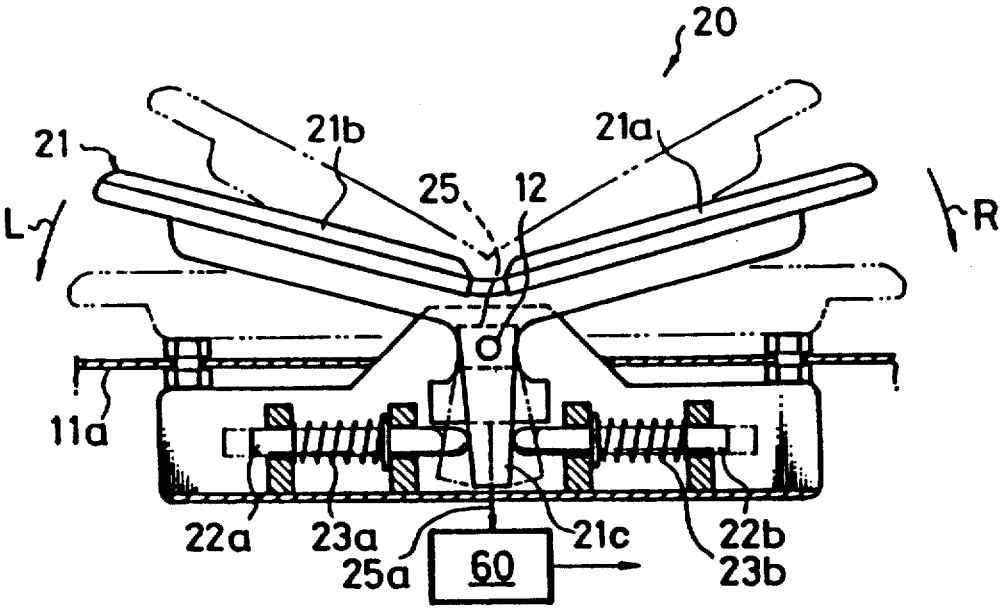
FIG. 3 is an enlarged side elevational view, partly in cross section, of foot treadles on the floor of the cabin.

As shown in FIG. 2, the cabin 10 has a floor 11a in front of an operator's seat 11, and the floor 11a supports first, second, third, and fourth foot treadles 20, 30, 40, 50 which are used to turn, raise and lower, and extend and contract the boom 3, and turn the cabin 10. The four foot treadles 20, 30, 40, 50 are identical in construction, and hence only the first foot treadle 20 will be described by way of example with reference to FIG. 3.

The foot treadle 20 has a treadle body 21 swingably mounted on the floor 11a by a support shaft 12 for rocking movement about the support shaft 12. The treadle body 21 has a central arm 21c projecting downwardly below the floor 11a. Two confronting pushers 22a, 22b are disposed below the floor 11a parallel thereto and have tip ends engageable with opposite sides, respectively, of the arm 21c which lie in the plane in which the treadle body 21 swings, the pushers 22a, 22b being slidable in the same plane. The pushers 22a, 22b are normally urged to cause their tip ends to be pressed against the opposite sides of the arm 21c by means of respective springs 23a, 23b disposed around the pushers 22a, 22b, respectively. When the pushers 22a, 22b are thus resiliently pressed against the arm 21c, the treadle body 21 is kept in a neutral position indicated by the solid lines in FIG. 3. The treadle body 21 is associated with a potentiometer 25 which detects swinging movement of the treadle body 21 about the support shaft 12 and produces a detected signal. The potentiometer 25 is electrically connected to a controller 60 through a signal line 25a. When the treadle body 21 is swung from the neutral position in the direction indicated by the arrow R or L by an operator's foot which depresses a lefthand portion 21b or a righthand portion 21a of the treadle body 21, such swinging movement is detected by the potentiometer 25, and a signal indicative of the detected swinging movement is transmitted from the potentiometer 25 to the controller 60.

Figure 4:
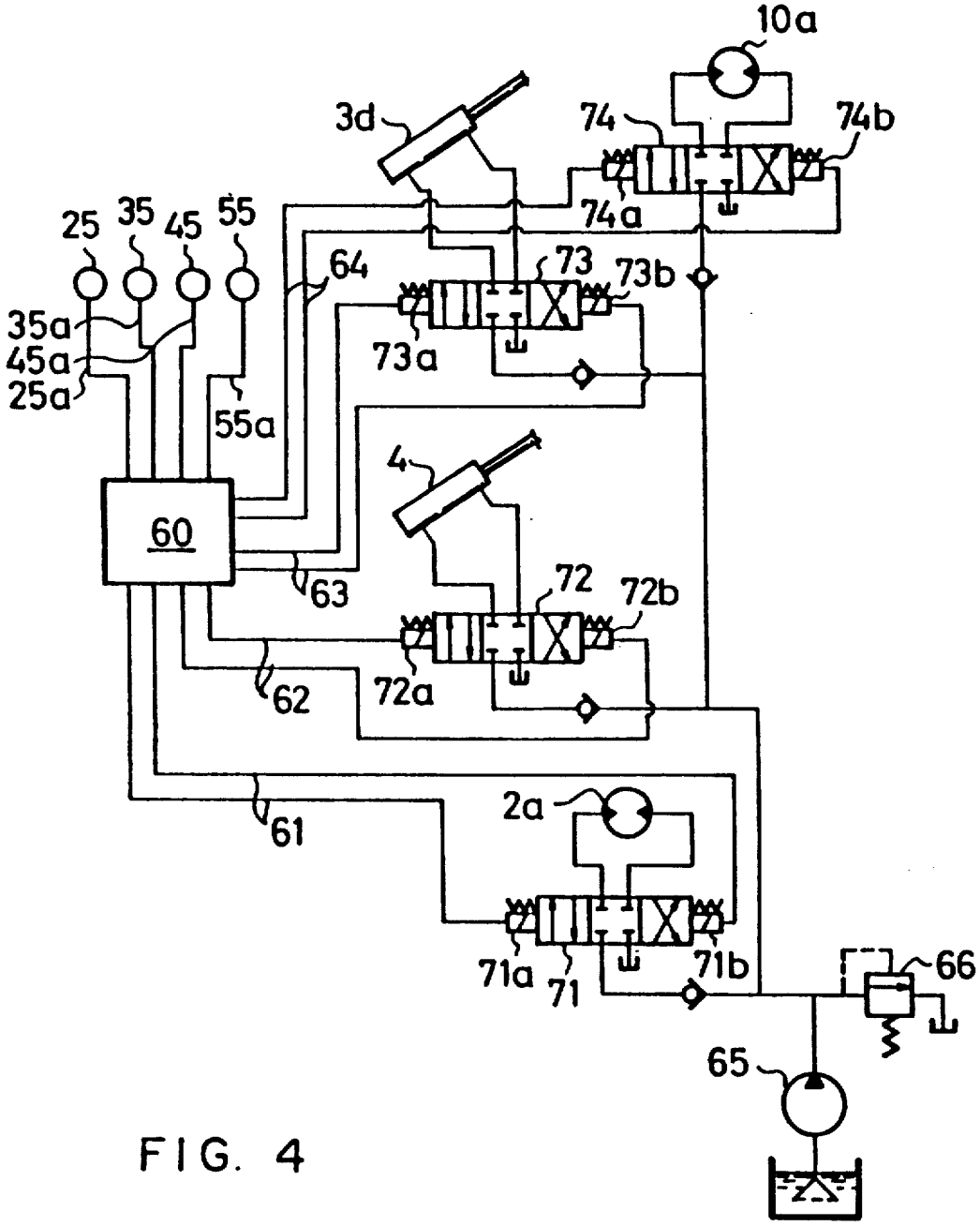
FIG. 4 is a diagram of a hydraulic circuit for controlling operation of the boom and aerial platform of the mobile vehicular apparatus.

Similarly, the foot treadles 30, 40, 50 are also associated with respective potentiometers 35, 45, 55 which detect swinging movement of treadle bodies 31, 41, 51 of the respective foot treadles 30, 40, 50. As shown in FIG. 4, detected signals from the respective potentiometers 25, 35, 45, 55 are transmitted to the controller 60 through signal lines 25a, 35a, 45a, 55a. The controller 60 serves to control turning movement of the turntable 2, raised and lowered movement and extended and contracted movement of the boom 3, and turning movement of the cabin 10. The controlling operation of the controller 60 will now be described below with reference to FIG. 4.

The turntable 2 is turned by a turntable motor 2a which is actuated by oil under pressure supplied from a hydraulic pump 65 and regulated in pressure by a regulator valve 66. The supply of oil under pressure to the turntable motor 2a is controlled to control the actuation of the turntable motor 2a by a first proportional solenoid-operated valve 71. The first proportional solenoid-operated valve 71 has two opposite solenoids 71a, 71b which are selectively energizable by control signals transmitted from the controller 60 through lines 61, thereby controlling the direction in which and the amount by which oil is supplied under pressure to the turntable motor 2a. The control signals from the controller 60 vary depending on the direction in which and the amount by which the foot treadle 20 is depressed. When the righthand portion 21a of the treadle body 21 is depressed, the turntable 2 is turned to the right or clockwise. When the lefthand portion 21b of the treadle body 21 is depressed, the turntable 2 is turned to the left or counterclockwise. The amount by which the treadle body 21 is depressed corresponds to the speed at which the turntable 2 turns. When the treadle body 21 is depressed a small amount, the turntable 2 turns slowly, and when the treadle body 21 is depressed a large amount, the turntable 2 turns rapidly.

The boom 3 can be raised and lowered by the cylinder 4 which is supplied with oil under pressure under the control of a second proportional solenoid-operated valve 72. The second proportional solenoid-operated valve 72 has two opposite solenoids 72a, 72b which are selectively energizable by control signals transmitted from the controller 60 through lines 62, thereby controlling the direction in which and the amount by which oil is supplied under pressure to the cylinder 4. The control signals from the controller 60 vary depending on the direction in which and the amount by which the second foot treadle 30 is depressed. When a front portion 31a of the treadle body 31 is depressed, the boom 3 is raised, and when a rear portion 31b of the treadle body 31 is depressed, the boom 3 is lowered. The speed at which the boom 3 is raised or lowered corresponds to the amount by which the second foot treadle 30 is depressed.

The boom 3 can be extended and contracted by a cylinder 3d housed therein which is supplied with oil under pressure under the control of a third proportional solenoid-operated valve 73. The third proportional solenoid-operated valve 73 has two opposite solenoids 73a, 73b which are selectively energizable by control signals transmitted from the controller 60 through lines 63, thereby controlling the direction in which and the amount by which oil is supplied under pressure to the cylinder 3d. The control signals from the controller 60 vary depending on the depression of the third foot treadle 40. When a front portion 41*a* of the treadle body 41 is depressed, the boom 3 is extended, and when a rear portion 41*b* of the treadle body 41 is depressed, the boom 3 is contracted.

The cabin 10 can be turned by a cabin motor 10*a* which is supplied with oil under pressure under the control of a fourth proportional solenoid-operated valve 74. The second proportional solenoid-operated valve 74 has two opposite solenoids 74*a*, 74*b* which are selectively energizable by control signals transmitted from the controller 60 through lines 64, thereby controlling the direction in which and the amount by which oil is supplied under pressure to the cabin motor 10*a*. The control signals from the controller 60 vary depending on the depression of the fourth foot treadle 50. When a righthand portion 51*a* of the treadle body 51 is depressed, the cabin 10 is turned to the right or clockwise. When a lefthand portion 51*b* of the treadle body 51 is depressed, the cabin 10 is turned to the left or counterclock wise.

When the first, second, third, and fourth foot treadles 20, 30, 40, 50 are depressed, as described above, the various hydraulic actuators such as hydraulic motors and cylinders are controlled in operation to turn the turntable 2, raise and lower the boom 3, extend and contract the boom 3, and turn the cabin 10, for thereby controlling the three-dimensional position of the cabin 10. Therefore, the operator M seated on the seat 11 in the cabin 10 can devote his both hands exclusively to the control of operation of the manipulators 9 with high efficiency.

Since the swinging movement of the foot treadles 20, 30, 40, 50 is detected by the respective potentiometers and electrically processed for the control of the hydraulic actuators, the control device is relatively simple in construction and can control the boom 3 and the cabin 10 with high accuracy.

The foot treadles 20, 30, 40, 50 are arranged as shown in FIG. 2. More specifically, the first foot treadle 20 for turning the turntable 2 and the fourth foot treadle 50 for turning the cabin 10 are oriented such that they swing laterally or to the right and the left with respect to the operator's seat 11, i.e., about an axis normal to the front edge of the seat 11. When the righthand portion 21*a* or 51*a* of the treadle body 21 or 51 is depressed, the turntable 2 or the cabin 10 turns to the right or clockwise. Therefore, the direction in which the treadles 20, 50 are depressed is the same as the direction in which the turntable 2 and the cabin 10 are turned. The second foot treadle 30 for raising and lowering the boom 3 and the third foot treadle 40 for extending and contracting the boom 3 are oriented such that they swing forwardly and rearwardly with respect to the operator's seat 11, i.e., about respective axes substantially parallel to the front edge of the seat 11. When the treadle body 31 of the second foot treadle 30 is depressed forwardly to lower its front portion, the boom 3 is raised to move the cabin 10 upwardly. When the treadle body 31 is depressed rearwardly to lower its rear portion, the boom 3 is lowered to move the cabin 10 downwardly. Likewise, when the treadle body 41 of the third foot treadle 40 is depressed forwardly to lower its front portion, the boom 3 is extended to move the cabin 10 forwardly. When the treadle body 41 is depressed rearwardly to lower its rear portion, the boom 3 is contracted to move the cabin 10 rearwardly.

Consequently, the foot treadles 20 through 50 are directed such that the directions in which the foot treadles are turned are equalized to the directions in which the cabin 10 is turned and moved. As a result, the foot treadles can easily and smoothly be operated on by the operator without much skill required on the part of the operator.

To use the mobile vehicular apparatus for a desired operation, the outriggers 8 are extended downwardly into contact with the ground to lift the vehicle body 1*b* off the ground. The operator M, who gets into the cabin 10, then depresses desired ones of the foot treadles 20, 30, 40, 50. The corresponding ones of the potentiometers 25, 35, 45, 50 detect the directions in which and the amounts by which the foot treadles are depressed, and apply detected signals to the controller 60. In response to the applied signals, the controller 60 operate corresponding hydraulic actuators (i.e., motors and cylinders) to turn the turntable 2, raise and lower the boom 3, extend and contract the boom 3, and/or turn the cabin 10, thereby bringing the cabin 10 into a desired three-dimensional position. Then, the operator M operates on a pair of manual control units (not shown) in the cabin 10 to move the corresponding manipulators 9. If the cabin 10 is to be moved while the manipulators 9 are being moved, then the operator M depresses a desired one or desired ones of the foot treadles 20, 30, 40, 50 with his foot or feet. Accordingly, the operator M can move the cabin 10 as desired while controlling the operation of the manipulators 10.

In the above embodiment, the cabin 10 is moved using the plural foot treadles 20, 30, 40, 50 on the floor 11*a* of the cabin 10. However, manual control levers for the control of the position of the cabin 10 can also be provided in the cabin 10 such that the cabin 10 may be moved using either the foot treadles or the manual control levers.

Figure 5:
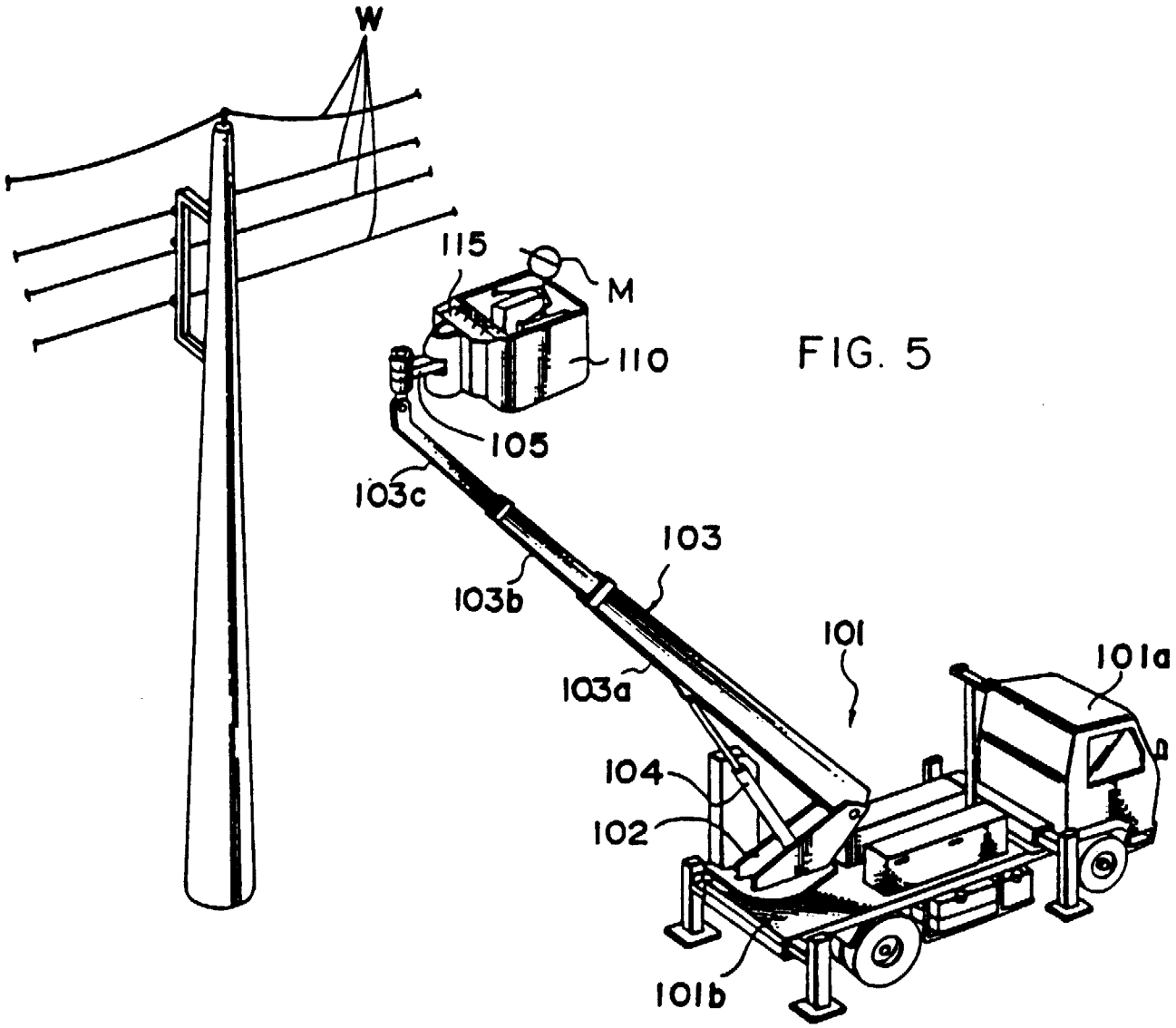
FIG. 5 is a perspective view of another mobile vehicular apparatus with an aerial platform, which incorporates the control device according to the present invention.

FIG. 5 shows another mobile vehicular apparatus which incorporates the control device according to the present invention.

The mobile vehicular apparatus, generally denoted at 101 in FIG. 5, has a driver's cabin 101*a* and a vehicle body 101*b*. The vehicle body 101*b* supports a turntable 102 on which there is mounted a telescopic boom 103 which is upwardly extensible and downwardly collapsible by a cylinder 104. The telescopic boom 103 comprises three boom members 103*a*, 103*b*, 103*c*. The boom member 103*c* at the distal end of the boom 103 supports a box-shaped bucket platform 110 through a support 105. A control unit 115 is attached to a front end of the platform 110. The operator M, who is carried in the platform 110, manually operates on the control unit 115 to turn the turntable 102, raise and lower the boom 103, extend and contract the boom 103, and turn the platform 110, thereby moving the platform 110 into a desired three-dimensional position.

The platform 110 has a floor on which four foot treadles are disposed just like the foot treadles shown in FIG. 2. The operator M can operate on these foot treadles with his feet to move the platform 110, instead of manually operating on the control unit 115. When electric cables W are replaced, repaired, installed, or otherwise processed using the mobile vehicular apparatus 101, as shown in FIG. 5, the operator M can handle the electric cables W with his both hands while operating on the foot treadles to move the platform 110 as desired. Therefore, the desired process for processing the electric cables W can be carried out highly efficiently.

Although certain preferred embodiments have been shown and described, it should be understood that many changes and modifications may be made therein without departing from the scope of the appended claims.

What is claimed is:

1. An apparatus for moving an operator around a three-dimensional aerial work location, comprising:

a mobile vehicle having a vehicle body;

a boom movably mounted on said vehicle body;

a platform mounted on a distal end of said boom, for carrying and operator thereon, said platform having an operator's seat and a floor which extends substantially horizontally; and a control device operable by the operator on said platform, for moving said boom to move said platform onto a three-dimensional position;

said control device comprising a plurality of swingable foot treadles disposed in front of said operator's seat, detecting means for detecting swinging movement of said foot treadles, and control means for controlling movement of said platform in response to detected signals from said detecting means;

said foot treadles being arranged for controlling substantially horizontal movements and substantially vertical movements of said platform such that said foot treadles arranged for controlling substantially horizontal movements of said platform are arranged such that swing directions of said foot treadles arranged for controlling substantially horizontal movements correspond to moving directions of said platform which result from said swing directions, and said foot treadles arranged for controlling substantially vertical movements of said platform are arranged such that swing directions of said foot treadles arranged for controlling substantially vertical movements correspond to upward and downward moving directions of said platform, respectively.

2. An apparatus according to claim 1, wherein said boom is mounted on said vehicle body for turning movement, raised and lowered movement, and extended and contracted movement, and said platform is mounted on the distal end of said boom for horizontal turning movement, and wherein said foot treadles include a first foot treadle for controlling turning movement of said boom, a second foot treadle for controlling raised and lowered movement of said boom, a third foot treadle for controlling extended and contracted movement of said boom, and a fourth foot treadle for controlling turning movement of said platform.

3. An apparatus according to claim 2, wherein said first foot treadle is swingable to the right and the left with respect to said operator's seat such that when said first foot treadle swings to the right and the left, said boom turns clockwise and counterclockwise, respectively, said second foot treadle is swingable forwardly and rearwardly with respect to said operator's seat such that when said second foot treadle swings forwardly and rearwardly, said boom is raised and lowered, respectively, said third foot treadle is swingable forwardly and rearwardly with respect to said operator's seat such that when said third foot treadle swings forwardly and rearwardly, said boom is extended and contracted, respectively, and said fourth foot treadle is swingable to the right and the left with respect to said operator's seat such that when said fourth foot treadle swings to the right and the left, said platform turns clockwise and counterclodkwise, respectively.

4. An apparatus according to claim 1, wherein each of said foot treadles is swingable to both sides about a neutral position, said detecting means comprising means for detecting the direction in which and the amount by which said foot treadles swing from said neutral position, said control means comprising means for establishing a direction in which said platform is to move depending on the direction detected by said detecting means and a speed at which said platform is to move depending on the amount detected by said detecting means.

5. An apparatus according to claim 4, wherein said detecting means comprises potentiometers.

6. An apparatus according to claim 2, further including hydraulic actuators for turning, raising and lowering, and extending and contracting said boom and for turning said platform, said control device including proportional solenoid-operated control valves for controlling said hydraulic actuators, respectively, said control means comprising means for controlling operation of said proportional solenoid-operated valves.

7. An apparatus according to claim 1, wherein said platform comprises a cabin for accommodating the operator therein.

8. An apparatus according to claim 1, wherein said platform comprises a box-shaped bucket for accommodating the operator therein.

9. An apparatus according to claim 1, wherein said control device includes a manual control unit in said platform for manually controlling movement of said platform.

10. An apparatus according to claim 1, further including a manipulator mounted on a front portion of said platform, said control device including a manual control device in said platform for controlling operation of said manipulator.

11. An apparatus according to claim 1, wherein said treadles are disposed on said floor.

* * * * *

UNITED STATES PATENT AND TRADEMARK OFFICE

CERTIFICATE OF CORRECTION

PATENT NO. : 5,107,954

DATED : April 28, 1992

INVENTOR(S) : M. FUJIMOTO

It is certified that error appears in the above-indentified patent and that said Letters Patent is hereby corrected as shown below:

On the cover page, Item [75], Inventor, change "Fujimoto: Mineyuki" to ---Mineyuki Fujimoto---.

At column 1, line 32, delete "his".

At column 1, line 33, insert ---his--- after "both".

At column 6, line 65, change "his both" to ---both his---.

At column 7, line 12 (claim 1, line 6), change "and" to ---an---.

At column 8, line 15 (claim 3, line 18), change "counterclodkwise" to ---counterclockwise---.

Signed and Sealed this

Sixteenth Day of May, 1995

Bruce Lehman

*Attest:*

BRUCE LEHMAN

*Attesting Officer*

*Commissioner of Patents and Trademarks*